United States Patent [19]

Maclay

[11] 4,324,160

[45] * Apr. 13, 1982

[54] ADJUSTABLE WRENCH

[76] Inventor: G. Jordan Maclay, 847 W. Newport, Chicago, Ill. 60657

[ * ] Notice: The portion of the term of this patent subsequent to Dec. 9, 1997, has been disclaimed.

[21] Appl. No.: 213,870

[22] Filed: Dec. 8, 1980

Related U.S. Application Data

[63] Continuation-in-part of Ser. No. 956,871, Nov. 1, 1978, Pat. No. 4,237,756.

[51] Int. Cl.[3] ..... B25B 13/58

[52] U.S. Cl. ..... 81/185

[58] Field of Search ..... 81/179, 185, 125.1, 81/DIG. 11

[56] References Cited

U.S. PATENT DOCUMENTS

| | | | |
|---|---|---|---|
| 102,336 | 4/1870 | Utley | 81/185 |
| 1,122,915 | 12/1914 | Hallum | 81/185 |
| 1,314,044 | 8/1919 | Buker | 81/185 |
| 2,910,902 | 11/1959 | Akers | 81/179 |
| 3,738,203 | 6/1973 | Cudd | 81/185 |
| 3,858,468 | 1/1975 | Pasbrig | 81/185 |
| 4,237,756 | 12/1980 | Maclay | 81/185 |

FOREIGN PATENT DOCUMENTS

| | | | |
|---|---|---|---|
| 593905 | 3/1934 | Fed. Rep. of Germany | 81/185 |
| 13897 | of 1893 | United Kingdom | 81/185 |
| 12331 | of 1896 | United Kingdom | 81/185 |

*Primary Examiner*—James G. Smith

*Attorney, Agent, or Firm*—Thomas R. Vigil

[57] ABSTRACT

The open ended wrench includes a manually graspable handle and a nut-seizing jaw formation connected to the handle. The jaw formation has a nut-receiving opening therein defined between an upper jaw member, a lower jaw member spaced a fixed distance from the upper jaw member and a jaw back portion extending between the upper and lower jaw members. A slot communicates with the opening and extends through the jaw back portion. A plurality of substantially equal length shims are longitudinally slidable through the slot from a location outside of the opening to a location inside of the opening to provide a variable dimension for the nut-receiving opening. Each of the shims has an interlock formation for preventing any shim from being located inside of the opening unless there is supportive contact with the jaw. In one embodiment, each shim has one end thereof formed with an offset end portion including an inclined section extending angularly from the plane of the shim and an end section extending from the inclined section. The offset end portion defines the interlock formation. In another embodiment, some of the shims are from a first group of shims which are rolled from stock having a first thickness dimension and some of the shims are from a second group of shims having a second thickness dimension slightly larger than the first thickness dimension. Each group of shims has essentially the same tolerance range, whereby nesting and stacking of said two groups of shims having different basic thickness dimensions is facilitated. Also, the wrench includes a manually manipulatable releasable locking assembly for releasably locking the shims in a desired position against the upper jaw member.

22 Claims, 8 Drawing Figures

FIG. 1
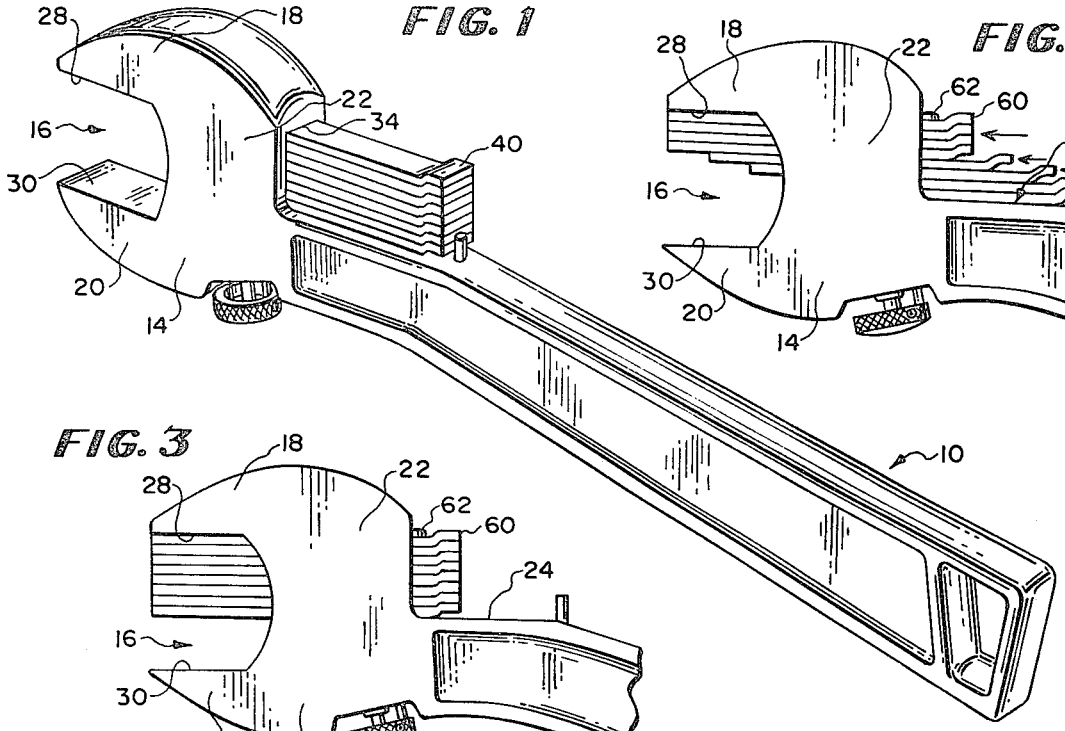
FIG. 2
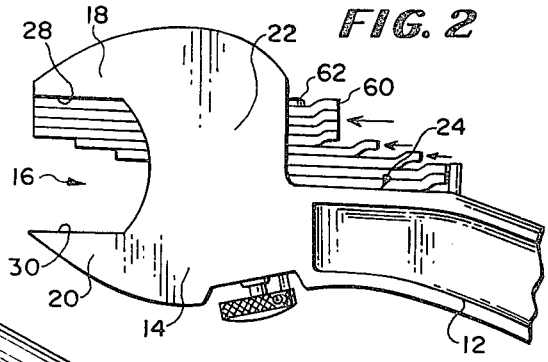
FIG. 3
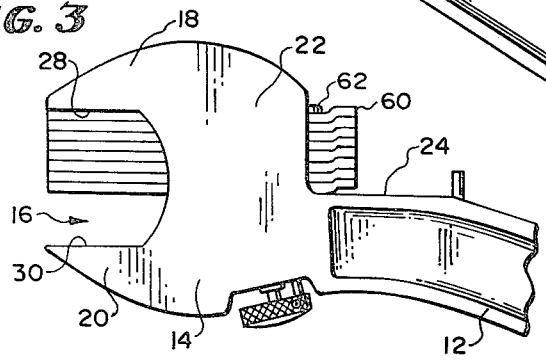
FIG. 4
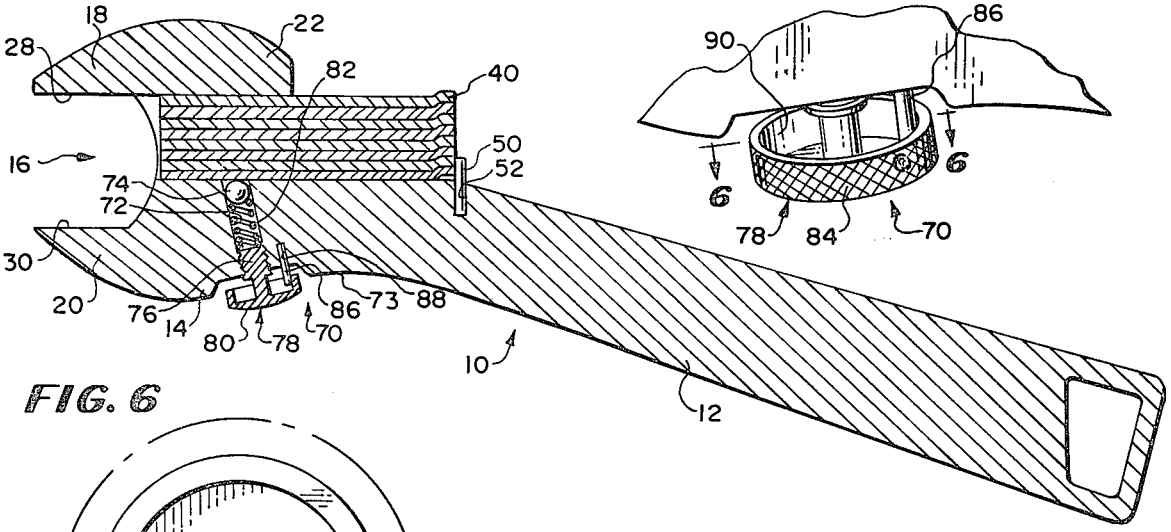
FIG 5
FIG. 6
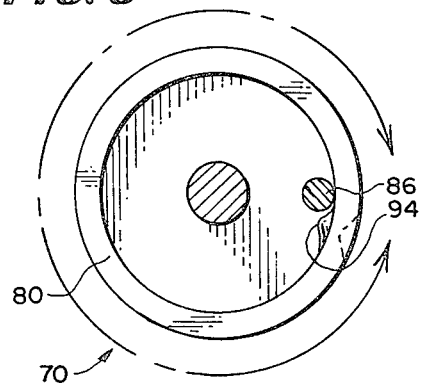
FIG. 7
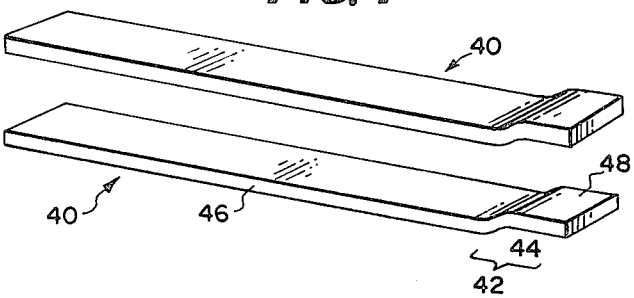
FIG. 8
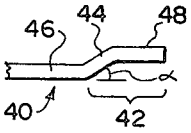

ADJUSTABLE WRENCH

CROSS REFERENCE TO RELATED APPLICATION

This application is a continuation-in-part of U.S. application Ser. No. 956,871 filed on Nov. 1, 1978, for: ADJUSTABLE WRENCH, which issued to U.S. Pat. No. 4,237,756 on Dec. 9, 1980.

BACKGROUND OF THE INVENTION

1. Field of the Invention

The present invention relates to an adjustable open-ended wrench. More specifically, the present invention relates to an adjustable open-ended wrench with a jaw formation having a nut-receiving opening therein in which the shims are slidably received to adjust the nut-receiving opening dimensions.

2. Description of the Prior Art

Heretofore various open-ended wrenches have been proposed including shims or slide members which are slid into or rotated into position within a nut-receiving opening of the jaw of the wrench to adjust the size of the nut receiving opening.

In this respect, a wrench very similar to the wrench of the present invention is disclosed in applicant's earlier application Ser. No. 956,871 filed on Nov. 1, 1978, and issued on Dec. 9, 1980 to U.S. Pat. No. 4,237,756.

The open-ended wrench of the present invention is an improvement over the wrench disclosed in U.S. Pat. No. 4,237,756, the disclosure of which is incorporated herein by reference.

In the disclosure in this patent, steel shims of substantially equal length were first punched out of a piece of rolled stock and, at one end of each shim, a portion thereof was displaced by a stamping or swagging operation so that on one planar surface of each shim there is a projection and on the opposite planar surface there is a recess into which a projection of an adjacent shim is received. The projections were made by punching halfway through the steel shim. The shims were then arranged on a shelf behind the jaw formation of the wrench in a nesting arrangement in position for movement through a slot in the jaw formation to a nut-receiving opening of the jaw formation to adjust the dimension of the nut-receiving opening.

The manner of forming the shims described above had some deficiency since the punched or stamped projection at 90° to the plane of each shim placed stress on the shims to the extent that the punched projections often broke off.

Additionally, because of the manufacturing tolerance of the shims, it was difficult to provide suitable vertical stacking and nesting of the shims.

Also, it was found to be desirable to provide some means for easily and releasably locking the shims in place within the nut-receiving opening.

As will be described in greater detail hereinafter, the open-ended adjustable wrench of the present invention provides a shim construction which can be simply formed in one stamping operation and one which provides for good vertical stacking and nesting of the shims and provides a simple, easily releasable locking means for releasably locking the shims in place.

SUMMARY OF THE INVENTION

According to the invention there is provided an open-ended wrench of the type including a manually graspable handle and a nut-seizing jaw formation connected to said handle, said jaw formation having a nut-receiving opening therein defined between an upper jaw member, a lower jaw member spaced a fixed distance from the upper jaw member and a jaw back portion extending between the upper and lower jaw members, a slot communicating with said opening and extending through said jaw back portion, a plurality of substantially equal length shims longitudinally slidable through said slot from a location outside of said opening to a location inside of said opening to provide a variable dimension for said nut-receiving opening, said plurality of shims comprising interlock means for preventing any shim from being located inside of said opening unless there is supportive contact with said jaw; said interlock means comprising projecting means carried by each of said shims and means on each said shim for receiving the projecting means of an underlying shim; and said plurality of shims being positioned for sequentially varying said nut-receiving opening dimension by longitudinally moving one or more of said shims into said opening with said shims that are moved into said opening being in supportive contact with said jaw.

In one preferred embodiment, each shim has one end thereof formed with an offset end portion including an inclined section extending angularly from the plane of said shim and an end section extending from the inclined section, said offset end portion defining said projecting means on one side thereof and said means for receiving the projecting means of an underlying shim on the other side thereof.

In another preferred embodiment, some of said shims are from a first group of shims which are rolled from stock having a first thickness dimension and some of said shims are from a second group of shims which are rolled from stock having a second thickness dimension slightly larger than said first thickness dimension, each group of shims having essentially the same tolerance range, whereby nesting and stacking of said two groups of shims having different basic thickness dimensions is facilitated.

In still another preferred embodiment, the wrench includes manually manipulatable releasable locking means for releasably locking said shims in a desired position against the upper jaw member.

BRIEF DESCRIPTION OF THE DRAWINGS

FIG. 1 is a perspective view of the open ended adjustable wrench of the present invention.

FIG. 2 is a side elevational view of a jaw formation of the open ended wrench shown in FIG. 1 and shows shims movable on a shelf from a retracted position to an extended position into a nut-receiving opening of the jaw formation for adjusting the size thereof.

FIG. 3 is a side elevational view of the jaw formation similar to the view shown in FIG. 2 and shows all the shims moved into the nut-receiving opening to reduce the size thereof to the minimum size provided by the wrench.

FIG. 4 is a vertical sectional view of the wrench shown in FIG. 1.

FIG. 5 is an exploded fragmentary view of a thumb screw located on the bottom of the jaw formation forming part of a locking assembly for releasably locking the shims in place.

FIG. 6 is a sectional view through the head of the thumb screw and is taken along line 6—6 of FIG. 5.

FIG. 7 is an exploded perspective view of two shims used in the wrench.

FIG. 8 is a fragmentary side elevational view of the offset end portion of one of the shims.

DESCRIPTION OF THE PREFERRED EMBODIMENT

Referring now to the drawings in greater detail there is illustrated in FIG. 1 an open-ended adjustable wrench 10 made in accordance with the teachings of the present invention. As shown, the wrench 10 includes an elongate handle portion 12 with a jaw formation 14 at one end thereof and integral with the handle portion 12. The jaw formation 14 has a generally U shaped nut-receiving opening 16 therein defined between an upper jaw member 18, a lower jaw member 20 and a jaw back portion 22. Behind the jaw back portion 22 and forming both an end of the handle portion 12 and part of the jaw formation 14 is a planar shelf 24.

As shown, the upper jaw member 18 has a planar surface 28 and the lower jaw member 20 has a planar surface 30. The planar surface 28 and 30 are generally parallel to each other and to the shelf 24.

As show, the jaw back portion 22 has a slot 34 therethrough which has a generally rectangular cross-section and through which a plurality of shims 40 are received for adjusting the size of the nut-receiving opening 15 of the jaw formation 14. In the illustrated embodiment eight shims 40 are provided thereby to provide the wrench 10 with a capability of handling nine different sized nuts.

In accordance with the teachings of the present invention and as now will be described in detail below, each of the shims 40 has a special construction which enables the wrench 10 to be manufactured with conventional manufacturing and assembly techniques and without incurring special tooling or assembly costs. In this respect, instead of forming each shim 40 with a partly punched out projection as disclosed in U.S. Pat. No. 4,237,756 referred to above, each of the shims 40 is formed with an offset end portion 42 comprising an inclined section 44 extending from the body 46 of the shim 40 upwardly at an acute angle $\alpha$ which can be from 30° to 60° and is preferably 45°. The end portion 42 further includes an end section 48 which extends from the inclined section 44 in a plane generally parallel to the plane of the body 46 of the shim 40.

Also, to facilitate the desired stacking and nesting of one shim 40 above the other, the thickness of the inclined section 44 is less than the thickness of the body 46 of the shim 40. This difference in thickness is preferably defined by multiplying the thickness of the body 46 of the shim 40 by one (1) minus the cosine of the acute angle $\alpha$.

The end section 48 is also slightly thinner than the body 46 of the shim 40 to facilitate nesting and the end portion 42 is preferably formed in a coining operation.

The upper surface of the offset end portion 42, namely the upper surface, of the inclined section section 44 and the end section 48 define a projection which limits the movement of the shims 40 into the slot 34. The space beneath the inclined section 44 and the end section 48 provides a recess for receiving the projection defined by the offset end portion 48 of the shim 40 therebeneath. With the end portion 42 formed in this matter, it is only necessary to provide a small stop 50 at one end of the shelf 24. This stop 50 is preferably in the form of a pin which is pressed into a bore 52 at the one end of the shelf 24 and need only extend from the handle 12 a distance sufficient to engage the end portion 42 of the lowermost shim 40 in the stack of shims 40. Then, of course, the end portion 42 of the shim above the lowermost shim 40 will be limited in its movement out of the nut-receiving opening 16 by engagement with the end portion 42 of the shim 40 therebeneath. This applies to the other shims 40 stacked one above the other as clearly shown in FIGS. 1 and 4.

If desired, the pin 50 can be cast integrally with the wrench 10 provided some means are provided to facilitate insertion of the shims 40 in the slot 34.

With the shims 40 formed with the offset end portion 42 in the manner described above in a coining operation, there are practically no failures in the shims thus manufactured as was the case with shims in which a projection was punched out of an end portion of the shim as taught in U.S. Pat. No. 4,237,756 referred to above.

Also in accordance with the teachings of the present invention and to facilitate assembly of shims 40 manufactured with conventional tolerances some, such as half, of the shims 40 are chosen from one group of shims 40 having a basic first thickness dimension, and some, namely half, of the shims 40 are chosen from a second group of shims 40 manufactured with a second basic thickness dimension. For example, the first group of shims 40 can be manufactured with a thickness of $0.061 \pm 0.005$ inch (0.16 cm) and the second group of shims 40 can be manufactured with a basic second thickness dimension of $0.064 \pm 0.005$ inch (0.16 cm). This provides a difference of roughly 0.002 inch (0.005 cm) between the first and second thickness dimensions. This facilitates assembly of the shims 40 and proper desired stacking of the shims as shown in the drawings. In this respect, if all the shims 40 were made from the same rolled steel stock having a basic thickness dimension with a tolerance of 0.0005 inch (0.0013 cm) and all of the shims 40 had a thickness at one end of the tolerance range, they would not fit properly within the slot 34 or in the nut-receiving opening 16. One solution to this problem would be to have a tighter tolerance range. However, that would so increase the cost of manufacture of the wrench 10 that it would be too expensive to compete with other wrenches on the market. However, by having the shims 40 made with two basic dimension thicknesses as described above, it has been found that differences in thickness due to the conventional manufacturing tolerances encountered cancel each other out and the possibility of tolerance differences being cumulative in one direction for eight shims 40 in a stack is eliminated. In this respect, and referring to the example given above, the desired basic thickness dimension would be 0.0625 inch (0.16 cm). However, half of the shims 40 are made with a basic thickness of 0.061 and the other half are manufactured with a basic thickness of 0.064 inch.

This manufacturing and assembly technique described above allows conventional manufacturing tolerances to be utilized without having the cumulative effect of shims 40 made at one end of the tolerance range adversely affecting the assembly of the shims 40 into the wrench 10.

Although movement of the shims 40 into the opening 16 is limited by the projection defined by the offset end portion 42 engaging an end portion 42 of a shim 40 thereabove or engaging the jaw formation 14 at the upper end of the slot 34, an uppermost shim 60 as shown in FIGS. 2 and 3 can have a protrusion 62 thereon forming an abutment for limiting movement of the uppermost shim 60 into the slot 34 with the protrusion 62 engaging the jaw formation 14 at the upper edge of the slot 34. The provision of such an abutment member 62 is disclosed in U.S. Pat. No. 4,237,756 referred to above.

Also in accordance with the teachings of the present invention the wrench 10 is provided with a locking assembly 70 for easily and releasably locking the shims 40 in a desired position.

The assembly 70 includes a passageway 72 within the jaw formation 14 extending from an underside 73 of the wrench 10 through the jaw portion 14 to the slot 34. At the end of the passageway 72 opening into the slot 34 there is located a ball bearing 74 forming a detent. At the other end of the passageway 72 there is threadedly received a threaded shank portion 76 of a thumb screw 78 which has a larger diameter knurled head 80. A spring 82 is received between the shank 76 and the ball bearing detent 74 within the passageway 72.

The head 80 of the thumb screw 78 has a generally mushroom cross section as shown in FIGS. 4 and 5 and is knurled on the outer periphery 84 thereof as shown in FIG. 5.

A pin 86 is received in a bore 88 (FIG. 4) parallel spaced from the axis of the passageway 72. The pin 86 is positioned to extend within a recess on the underside of the mushroom cap shaped head 80 adjacent an inner cylindrical surface 90 of the head 80 as shown in FIG. 5.

In assembling the locking assembly 70 the ball bearing 74 and the spring 82 are inserted in the passageway 72. Then the thumb screw 78 is screwed into the passageway 72 until the shims 40 are just locked up by the ball bearing detent 74 bearing thereagainst. Then a detent 94 is formed on the inner cylindrical surface 90 by punching or swagging in the side of the mushroom shaped head 80 of the thumb screw 78 as best shown in FIG. 6. Now the thumb screw 78 can only be rotated one revolution so as to move the detent 94 from one side of the pin 86 to the other side of the pin 86. In one position the ball bearing detent 74 locks the shims in place and in the other position spring pressure on the ball bearing detent 74 is released so that the shims 40 are unlocked and can be easily moved in and out of the opening 16 through the slot 34. This construction of the locking assembly 70 prevents the thumb screw 78 from being withdrawn from the passageway 72 after the parts of the assembly 70 have been assembled and the head 80 of the thumb screw 78 is punched or swaged in as shown in FIGS. 5 and 6.

From the foregoing description it will be apparent that the adjustable open-ended wrench 10 of the present invention has a number of advantages, some of which have been described above and others of which are inherent in the invention.

More specifically, the construction of the shims 40, the manufacturing techniques utilized in making such shims 40 and the manner of their assembly in the wrench 10 enable the wrench 10 to be manufactured and assembled using conventional manufacturing techniques thereby to maintain a low cost of manufacture while at the same time ensuring accurate construction and assembly of the parts of the wrench 10, particularly so that the shims 40 can be stacked and nested in a vertical arrangement for proper functioning of the wrench 10.

Also, the simple locking assembly 70 provides for simple manufacture and assembly of such assembly 70 to provide an easily releasable locking mechanism for locking the shims 40 in place within the nut-receiving opening 16 of the wrench 10.

It will be understood by those skilled in the art that many modifications can be made to the wrench 10 described above without department from the teachings of the present invention. Accordingly, the scope of the present invention is only to be limited as necessitated by the accompanying claims.

I claim:

1. In an open-ended wrench of the type including a manually graspable handle and a nut-seizing jaw formation connected to said handle, said jaw formation having a nut-receiving opening therein defined between an upper jaw member, a lower jaw member spaced a fixed distance from the upper jaw member and a jaw back portion extending between the upper and lower jaw members, a slot communicating with said opening and extending through said jaw back portion, a plurality of substantially equal length shims longitudinally slidable through said slot from a location outside of said opening to a location inside of said opening to provide a variable dimension for said nut-receiving opening, said plurality of shims comprising interlock means for preventing any shim from being located inside of said opening unless there is supportive contact with said jaw; said interlock means comprising projecting means carried by each of said shims and means on each said shim for receiving the projecting means of an underlying shim; and said plurality of shims being positioned for sequentially varying said nut-receiving opening dimension by longitudinally moving one or more of said shims into said opening with said shims that are moved into said opening being in supportive contact with said jaw, the improvement comprising each said shim having one end thereof formed with an offset end portion including an inclined section extending angularly from the plane of the shim and an end section extending from the inclined section, said offset end portion defining said projecting means on one side thereof and said means for receiving the projecting means of an underlying shim on the other side thereof.

2. The wrench according to claim 1 wherein said end section extends generally parallel to the plane of said shim.

3. The wrench according to claim 1 wherein the angle between said inclined section and the plane of said shim is between 30° and 60°.

4. The wrench according to claim 3 wherein said angle is approximately 45°.

5. The wrench according to claim 1 wherein said plurality of shims are arranged in a stack in nesting engagement with each other and wherein the uppermost shim in said stack has a protrusion on the upper side thereof forming an abutment for engaging said jaw back portion adjacent said slot to prevent the shims from sliding further than a predetermined distance into said slot.

6. In an open-ended wrench of the type including a manually graspable handle and a nut-seizing jaw formation connected to said handle, said jaw formation having a nut-receiving opening therein defined between an upper jaw member, a lower jaw member spaced a fixed distance from the upper jaw member and a jaw back portion extending between the upper and lower jaw members, a slot communicating with said opening and extending through said jaw back portion, a plurality of substantially equal length shims longitudinally slidable through said slot from a location outside of said opening to a location inside of said opening to provide a variable dimension for said nut-receiving opening, said plurality of shims comprising interlock means for preventing any shim from being located inside of said opening unless there is supportive contact with said jaw; said interlock means comprising projecting means carried by each of said shims and means on each said shim for receiving the projecting means of an underlying shim; and said plurality of shims being positioned for sequentially varying said nut-receiving opening dimension by longitudinally moving one or more of said shims into said opening with said shims that are moved into said opening being in supportive contact with said jaw, the improvement comprising manually manipulatable releasable locking means for releasably locking said shims in a desired position against the upper jaw member.

7. The wrench according to claim 6 wherein said locking means comprises a passageway in said jaw back portion and opening into said slot at one end and onto a lower surface of the jaw formation at the other end, a detent located in said passageway at the end thereof opening into said slot, a thumb screw threadedly received in said passageway at the end thereof opening onto the lower surface, and biasing means between said detent and said thumb screw.

8. The wrench according to claim 7 wherein said detent is a ball bearing, said biasing means is a spring, and said thumb screw includes a threaded shank portion and an enlarged finger grippable head portion.

9. The wrench according to claim 8 including means for limiting rotation of said head portion of the thumb screw to one revolution between a shim release position and a shim locking position.

10. In an open-ended wrench of the type including a manually graspable handle and a nut-seizing jaw formation connected to said handle, said jaw formation having a nut-receiving opening therein defined between an upper jaw member, a lower jaw member spaced a fixed distance from the upper jaw member and a jaw back portion extending between the upper and lower jaw members, a slot communicating with said opening and extending through said jaw back portion, a plurality of substantially equal length shims longitudinally slidable through said slot from a location outside of said opening to a location inside of said opening to provide a variable dimension for said nut-receiving opening, said plurality of shims comprising interlock means for preventing any shim from being located inside of said opening unless there is supportive contact with said jaw; said interlock means comprising projecting means carried by each of said shims and means on each said shim for receiving the projecting means of an underlying shim; and said plurality of shims being positioned for sequentially varying said nut-receiving opening dimension by longitudinally moving one or more of said shims into said opening with said shims that are moved into said opening being in supportive contact with said jaw, the improvement residing in some of said shims being from a first group of shims having a first thickness dimension and some of said shims being from a second group of shims having a second thickness dimension slightly larger than said first thickness dimension, each group of shims having essentially the same tolerance range, whereby nesting and stacking of said two groups of shims having different basic thickness dimensions is facilitated.

11. The wrench according to claim 10 wherein the difference between the thickness dimensions is approximately 0.002 inch (0.005 cm).

12. The wrench according to claim 10 wherein the tolerance from the basic thickness dimension is approximately $\pm 0.0005$ inch (0.001 cm).

13. The wrench according to claim 10 wherein the first thickness dimension is approximately $0.061 \pm 0.0005$ inch (0.16 cm) and the second thickness dimension is approximately $0.064 \pm 0.0005$ inch (0.16 cm).

14. The wrench according to claim 10 wherein each said shim has one end thereof formed with an offset end portion including an inclined section extending angularly from the plane of the shim and an end section extending from the inclined section, said offset end portion defining said projecting means on one side thereof and said means for receiving the projecting means of an underlying shim on the other side thereof.

15. The wrench according to claim 14 wherein said end section extends generally parallel to the plane of said shim.

16. The wrench according to claim 14 wherein the angle between said inclined section and the plane of said shim is between 30° and 60°.

17. The wrench according to claim 16 wherein said angle is approximately 45°.

18. The wrench according to claim 10 wherein said plurality of shims are arranged in a stack in nesting engagement with each other and wherein the uppermost shim in said stack has a protrusion on the upper side thereof forming an abutment for engaging said jaw back portion adjacent said slot to prevent the shims from sliding further than a predetermined distance into said slot.

19. The wrench according to claim 14 wherein said inclined section of said end portion of each shim is thinner than the body of said shim to provide for good vertical stacking and nesting of said shims.

20. The wrench according to claim 19 wherein said inclined section thickness is defined by multiplying the thickness of the body of said shim by 1 minus the cosine of the acute angle between the plane of the shim and the inclined section.

21. The wrench according to claim 1 wherein said inclined section of said end portion of each shim is thinner than the body of said shim to provide for good vertical stacking and nesting of said shims.

22. The wrench according to claim 21 wherein said inclined section thickness is defined by multiplying the thickness of the body of said shim by 1 minus the cosine of the acute angle between the plane of the shim and the inclined section.

* * * * *